US010821759B2

(12) United States Patent
Ren

(10) Patent No.: US 10,821,759 B2
(45) Date of Patent: Nov. 3, 2020

(54) SYSTEM FOR FORMING SAFETY PATTERN BY MAGNETIC AND OPTICAL FIELD

(71) Applicant: Xianyang Homa Optoelectronic Technology Co., Ltd., Shaanxi (CN)

(72) Inventor: Lei Ren, Guangdong (CN)

(73) Assignee: Xianyang Homa Optoelectronic Technology Co., Ltd., Xianyang (CN)

( * ) Notice: Subject to any disclaimer, the term of this patent is extended or adjusted under 35 U.S.C. 154(b) by 0 days.

(21) Appl. No.: 16/459,619

(22) Filed: Jul. 2, 2019

(65) Prior Publication Data

US 2019/0322112 A1 Oct. 24, 2019

Related U.S. Application Data

(63) Continuation of application No. PCT/CN2017/113730, filed on Nov. 30, 2017.

(30) Foreign Application Priority Data

Dec. 1, 2016 (CN) ..... 2016 1 1095482
Dec. 1, 2016 (CN) ..... 2016 2 1314510 U
Aug. 7, 2017 (CN) ..... 2017 1 0667828
Aug. 7, 2017 (CN) ..... 2017 2 0982564 U

(51) Int. Cl.
*B41M 3/14* (2006.01)
*B41F 11/02* (2006.01)

(52) U.S. Cl.
CPC ..... *B41M 3/148* (2013.01); *B41F 11/02* (2013.01)

(58) Field of Classification Search
CPC ..... B41M 3/148; B41M 3/14; B41M 5/382; B41F 11/02; B41F 17/00
USPC ..... 347/51, 101, 105–107
See application file for complete search history.

(56) References Cited

U.S. PATENT DOCUMENTS 7,047,883 B2 * 5/2006 Raksha ..... B05D 3/207 101/489
8,286,551 B2 * 10/2012 Gygi ..... B41F 15/0804 101/116
10,226,790 B2 * 3/2019 Raksha ..... G03G 15/2007
2013/0183067 A1 * 7/2013 Degott ..... G03G 15/09 399/267

FOREIGN PATENT DOCUMENTS

CN 1929995 A 3/2007
CN 1812886 B 3/2012
(Continued)

OTHER PUBLICATIONS

International Search Report of PCT Patent Application No. PCT/CN2017/113730 dated Feb. 24, 2018.

*Primary Examiner* — An H Do

(57) ABSTRACT

A system for forming a security pattern by magnetic and optical fields includes: a printing substrate having an inducible ink pattern printed on its surface; and at least one set of security pattern forming units through which the printing substrate passes sequentially. Each set of security pattern forming units includes: a magnetic field and a light source each acting on a surface of the printing substrate, such that after the printing substrate passes through the security pattern forming unit, an inducible ink pattern on the surface thereof exhibits the effect of the dual function of the optical field and the magnetic field.

17 Claims, 5 Drawing Sheets

(56) References Cited

FOREIGN PATENT DOCUMENTS

| | | | |
|---|---|---|---|
| CN | 102616042 | A | 8/2012 |
| CN | 103119521 | A | 5/2013 |
| CN | 103722917 | A | 4/2014 |

* cited by examiner

SYSTEM FOR FORMING SAFETY PATTERN BY MAGNETIC AND OPTICAL FIELD

CROSS REFERENCE TO RELATED APPLICATIONS

The present application is a Continuation Application of PCT Application No. PCT/CN2017/113730 filed on Nov. 30, 2017, which claims the benefit of Chinese Patent Application Nos. 201611095482.9 and 201621314510.7 filed on Dec. 1, 2016, and 201710667828.6 and 201720982564.9 filed on Aug. 7, 2017. All the above are hereby incorporated by reference.

TECHNICAL FIELD

The present invention belongs to the technical field of anti-counterfeiting printing, in particular to the field mainly applied to banknote printing, in particular to a system for forming a security pattern by magnetic and optical fields and a preparation system thereof.

BACKGROUND

In October 2015, the People's Bank of China issued a new version of the 100-yuan bill with chromatic color-changing ink, the core technology of which is the magnetic-optically variable ink jointly developed by JDSU company and Sicpa company. JDSU company has registered a large number of patents for the application of magnetic-optically variable ink, in which the most important patent is the application of 200480018382.5 titled as METHOD AND MEANS FOR PRODUCING PATTERNS IN THE COATING CONTAINING MAGNETIC PARTICLES DUE TO THE INDUCTION UNDER THE ACTION OF MAGNETIC FIELDS FILED in 2004. The technology has been applied to anti-counterfeiting banknotes in multi countries such as Euros and British Pounds; it is worth mentioning that the core technical elements of forming safe printing patterns available from JDSU company and Sicpa company are printing patterns and magnetic plate patterns.

It is an object of the present invention to explore a more complicated, more anti-counterfeiting banknote printing solution and apparatus.

SUMMARY

The object of the present invention is achieved by the following technical solutions:

a system for forming a security pattern by magnetic and optical fields, comprising: a printing substrate having an inducible ink pattern printed on its surface, and at least one set of security pattern forming units through which the printing substrate passes sequentially, wherein each set of security pattern forming units comprises: a magnetic field and a light source each acting on a surface of the printing substrate, such that after the printing substrate passes through the security pattern forming unit, an inducible ink pattern on the surface thereof exhibits the effect of the dual function of the optical field and the magnetic field.

Specifically, the system for forming a security pattern by magnetic and optical fields comprises a printing substrate having an inducible ink pattern printed on its surface, and at least one set of security pattern forming units, each set of security pattern forming units comprises: an external magnetic field, a conveying device provided between two magnetic poles of the external magnetic field or at a single pole of the magnetic field, a pattern light roller having a pattern light source on the surface, and a light shielding body; wherein the pattern light roller is provided above the printing substrate, the light shielding body is provided between the pattern light roller and the printing substrate and is configured to shield the pattern light roller to expose only a linear slit to the printing substrate, the conveying device is configured to drive the printing substrate to move relative to the light shielding body; transfer the pattern on the surface of the pattern light roller to the surface of the printing substrate under the action of the external magnetic field by rolling the pattern light roller, and form a magnetic plate pattern on the surface of the printing substrate from the magnetic field formed by the shape of the external magnetic field or the pattern on the surface of the magnetic pole at the same time.

The external magnetic field may be any type of magnetic fields: a track-type magnetic field, a permanent magnetic field, an electromagnetic field; any pattern such as a column shape, a horseshoe shape, a uniform magnetic field, a spherical crown magnetic field, and the like.

The function of the light shielding body is to ensure that the two-dimensional pattern on the pattern light roller is transferred to the printing substrate in a one-dimensional manner.

The magnetic plate pattern is constructed according to the distribution of the magnetic field and the distribution of the magnet. The new version of RMB 100 has a side pattern using the simplest strip magnet pattern.

The surface is printed with an inducible ink pattern in which the pigment flakes are induced in the magnetic field according to the pattern of the magnetic field, thereby transferring the magnetic field pattern to the ink pattern.

When transferring the pattern on the pattern light roller, a round to flat method or a round to round method can be used.

Optionally, both the conveying device below the pattern light roller and the printing substrate are planar, and the pattern on the pattern light roller is transferred to the surface of the printing substrate by one-way translation of the conveying device.

Another optional manner is that the conveying device below the pattern light roller is a cylindrical conveying roller, and the printing substrate on the surface thereof is rolled and conveyed, thereby transferring the pattern on the pattern light roller to the surface of the printing substrate.

Another system for forming a security pattern by magnetic and optical fields comprises:

a printing substrate having an inducible ink pattern printed on its surface, and at least one set of security pattern forming units, wherein each set of security pattern forming units comprises: a pattern light roller and a track-type magnetic field provided opposite to each other from top to bottom, and a conveying device configured to convey the printing substrate, the printing substrate is provided between the pattern light roller and the track-type magnetic field, the track-type magnetic field is synchronized with the conveying device; a light shielding body is provided between the pattern light roller and the printing substrate and is configured to shield the light roller to expose only a linear slit to the printing substrate; the conveying device is configured to drive the printing substrate to move relative to the light shielding body; transfer the pattern on the surface of the pattern light roller to the surface of the printing substrate by the rolling of the pattern light roller and the movement of the track-type magnetic field, and form a magnetic plate pattern on the surface of the printing substrate from the track-type magnetic field at the same time.

The track-type magnetic field is a rubber magnetic track or a magnetic plate loaded track; and the pattern light roller is a structure provided with a light source in the internal part and provided with a hollow pattern in the external part.

The printing substrate having an inducible ink pattern printed on its surface may be a piece of paper or plastic film having an inducible ink pattern printed on its surface.

The present invention further provides a security pattern formed by magnetic and optical fields, comprising:

an ink pattern printed on a surface of a substrate, a magnetic field pattern and an optical field pattern formed on the ink pattern.

The principle of the above system for forming a security pattern is that the magnetic plate pattern is constructed according to the distribution of the magnetic field and the distribution of the magnet. The new version of RMB 100 has a side pattern using the simplest strip magnet pattern; the surface of the printing substrate is printed with an inducible ink pattern in which the pigment flakes are induced in the magnetic field according to the pattern of the magnetic field, thereby transferring the magnetic field pattern to the ink pattern.

Another system for forming a security pattern by magnetic and optical fields is provided, the security pattern is a variable security pattern, comprising: a printing substrate having an inducible ink coating printed on its surface, and magnetic and optical fields configured to form a variable security pattern on the surface of the optical field; wherein the magnetic and optical fields comprise an optical field and a magnetic field, the optical field is formed by a controllable light roller, the controllable light roller is mounted with several independently controllable light source units in an array on the roller surface of a certain size, the light source units have curing function for the ink coating on the printing substrate; different optical patterns are formed at different time points by controlling the switch of the light source unit on the surface of the light roller, and the pattern is then transferred to a coating on the surface of the printing substrate; the magnetic field is used to form a magnetic field pattern on the surface of the coating of the printing substrate.

The magnetic and optical fields further comprise: a conveying device provided between two magnetic poles of the magnetic field or at a single pole of the magnetic field, and a light shielding body; wherein the controllable light roller is provided above the printing substrate, the light shielding body is provided between the controllable light roller and the printing substrate and is configured to shield the controllable light roller to expose only a linear slit to the printing substrate, the conveying device is configured to drive the printing substrate to move relative to the light shielding body; transfer the pattern on the surface of the controllable light roller to the surface of the printing substrate under the action of the magnetic field by rolling the controllable light roller, and form a magnetic plate pattern on the surface of the printing substrate from the magnetic field formed by the shape of the magnetic field or the pattern on the surface of the magnetic pole at the same time.

The linear slit has a line width of 0.1 to 3 mm, and the light-emitting unit on the controllable light roller is a rectangle having a physical size of no more than 0.1 to 3 square millimeters.

Preferably, both the conveying device and printing substrate below the controllable light roller are planar, and the pattern on the controllable light roller is transferred to the surface of the printing substrate by one-way translation of the conveying device; alternatively, the conveying device is a cylindrical conveying roller, and the light shielding body matches the shape of the conveying roller.

Preferably, the magnetic field is a permanent magnetic field, an electromagnetic field and a track-type magnetic field synchronized with the conveying device; the shape of the permanent magnetic field or the electromagnetic field is a cylindrical shape, a horseshoe shape, a uniform magnetic field or a spherical crown magnetic field, and the track magnetic field is rubber magnetic track or a magnetic plate loaded track. The distance between the magnetic device and the printing substrate having an inducible ink coating printed on the surface will show different effects according to the magnetic field selection design. The magnetic device cannot be in contact with the printing substrate and cannot be too far away from the printing substrate, resulting in the ink coating exceeding the magnetic field range.

Another system for forming a security pattern by magnetic and optical fields comprises: a printing substrate having an inducible ink coating printed on its surface, and magnetic and optical fields configured to form a variable security pattern on the surface of the optical field; wherein the magnetic and optical fields comprise an optical field and a magnetic field, the optical field is consisted of a linear writing light source, the magnetic field is a track-type magnetic field or a stationary magnetic field; the magnetic and optical fields further comprise a conveying device configured to convey the printing substrate, the printing substrate is provided between the linear writing light source and the magnetic field, when the magnetic field is a track-type magnetic field, the track-type magnetic field is synchronized with the conveying device, the pattern pre-written by the linear writing light source is transferred to the surface of the printing substrate by control of the linear writing light source and movement of the track-type magnetic field, and a magnetic plate pattern is formed on the surface of the printing substrate from the track-type magnetic field at the same time; when the magnetic field is a stationary magnetic field, the pattern pre-written by the linear writing light source is transferred to the surface of the printing substrate by control of the linear writing light source, and a magnetic plate pattern is formed on the surface of the printing substrate from the magnetic field formed by the shape of the magnetic field or the pattern on the surface of the magnetic pole at the same time.

Preferably, the track-type magnetic field is a rubber magnetic track or a magnetic plate loaded track.

Preferably, the linear writing light source is a single row of light sources consisted of several single-point writing light sources, which achieves a change in the optical signal of the overall linear writing light source by controlling the on/off of the single-point writing light sources and has curing function for the ink coating printed on the substrate, each row of light sources has a line width of 0.1 to 3 mm, preferably 0.5-1 mm, and the light-emitting system thereof is combined by an applied optical system, a fiber system, and a light baffle or the like.

Preferably, the light-emitting part of the linear writing light source is a rectangle of no more than 0.1 to 1 square millimeters.

The principle of the above two systems for forming a security pattern by magnetic and optical fields is to cut the ink coating on the surface of the printing substrate, specifically indicating that: the magnetic plate pattern is constructed according to the distribution of the magnetic field and the distribution of the magnet; the surface of the printing substrate is printed with an inducible ink pattern in which the pigment flakes are induced in the magnetic field according to the pattern of the magnetic field, resulting in a change in the arrangement direction of the pigment flakes, thereby transferring the magnetic field pattern to the ink pattern; since the optical field is variable, the ink on the surface of the printing substrate induced by the magnetic field is then again patterned by the controllable variable optical field.

Compared with the prior art, the present invention has the following advantages.

In the process of using the optical field pattern, the present invention transfers a two-dimensional pattern to the substrate in a one-dimensional pattern manner. The used method is a pattern light roller plus shielding method. The advantage of conveying the pattern using these two methods is as follows: 1. the pattern in which the existing printing pattern and the magnetic plate pattern are combined can be arbitrarily cut two-dimensionally, and the final anti-counterfeiting pattern can be expanded more diversely, 2. it is ensured that the pattern is continuously and efficiently produced, and 3. it is ensured that the boundary of the optical field pattern is clear.

If the security pattern is a variable security pattern, the technical solution of the present invention adopts a controllable optical field, and each of the formed security patterns has a controllable difference, thereby completing the machine-readable-type one-object-one-code or machine-readable-type implicit pattern of anti-counterfeiting traceability requirements. The security pattern formed is more secure and anti-counterfeiting, the traceable function is stronger and more complicated, and contains more information; in practical applications, a plurality of sets of controllable light rollers and the number of magnetic field patterns can be increased to form a more complicated anti-counterfeiting pattern, so as to achieve the purpose that it is more difficult to copy.

In summary, several systems for preparing a security pattern of the present invention use the magnetic and optical fields to affect the inducible ink on the surface of the printing substrate. The core technical element of forming a security pattern is the effect of combining a printing pattern, a magnetic plate pattern and an optical field pattern, and the formed anti-counterfeiting pattern is more complicated and richer.

DESCRIPTION OF THE EMBODIMENTS

Embodiment 1

This embodiment provides a system and method for forming a security pattern by magnetic and optical fields.

Figure 1:
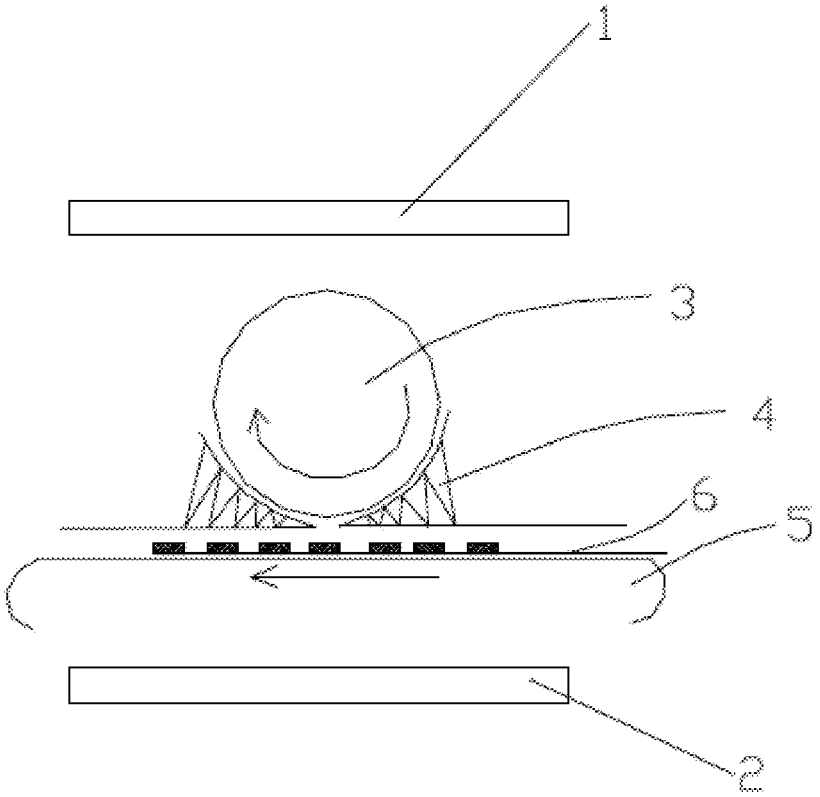
FIG. 1 is a cross-sectional schematic diagram illustrating the structure of a system for forming a security pattern by magnetic and optical fields according to Embodiment 1 of the present invention.

As shown in FIG. 1, the system for forming a security pattern by the magnetic and optical fields comprises: a uniformly strong magnetic field formed by two magnetic poles 1 and 2 provided in parallel from top to bottom, a pattern light roller 3 having a pattern light source on its surface provided between the two magnetic poles 1 and 2 of the magnetic field, a light shielding body 4, a conveying device 5, and a printing substrate 6 having an inducible ink pattern printed on its surface and conveyed by the conveying device 5.

The pattern light roller 3 is provided above the printing substrate 6, the light shielding body 4 is provided between the pattern light roller 3 and the printing substrate 6 and is configured to shield the pattern light roller 3 to expose only a linear slit to the printing substrate 6, the conveying device 5 is provided at the bottom of the printing substrate 6 and is configured to drive the printing substrate 6 to move relative to the light shielding body 4; transfer the pattern on the surface of the pattern light roller 3 to the surface of the printing substrate 6 under the action of the rolling of the pattern light roller 3 and the induction of the magnetic field, and form a magnetic and optical field security pattern.

In the present embodiment, the conveying device 5 is a conveyor belt.

Embodiment 2

Figure 2:
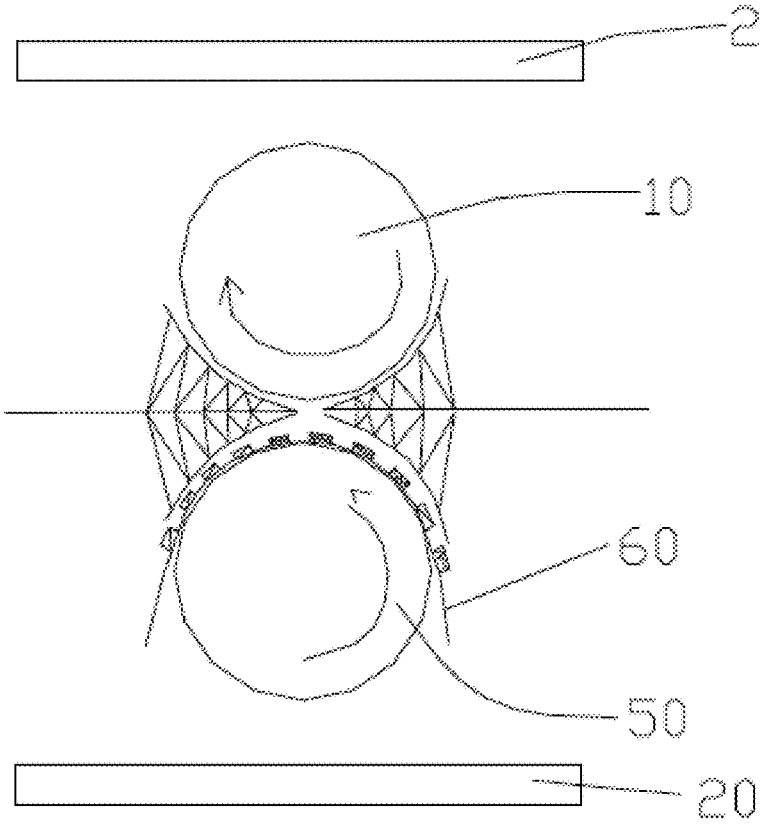
FIG. 2 is a cross-sectional schematic diagram illustrating the structure of a system for forming a security pattern by magnetic and optical fields according to Embodiment 2 of the present invention.

This embodiment provides another system for forming a security pattern by magnetic and optical fields, the structure of which is similar to that of Embodiment 1, as shown in FIG. 2. The only difference is that the conveying device below the pattern light roller 30 of the two magnetic poles 10, 20 provided in parallel from top to bottom is a cylindrical conveying roller 50, and the cylindrical conveying roller 50 is rolled by autorotation so that the printing substrate 60 on the surface thereof is rolled and conveyed, thereby transferring the pattern on the surface of the patterning roller 30 to the surface of the printing substrate 60.

Embodiment 3

This embodiment provides a system for forming a security pattern by magnetic and optical fields, the structure of which is similar to that of Embodiment 1. The only difference is that the used magnetic field is different.

Figure 3:
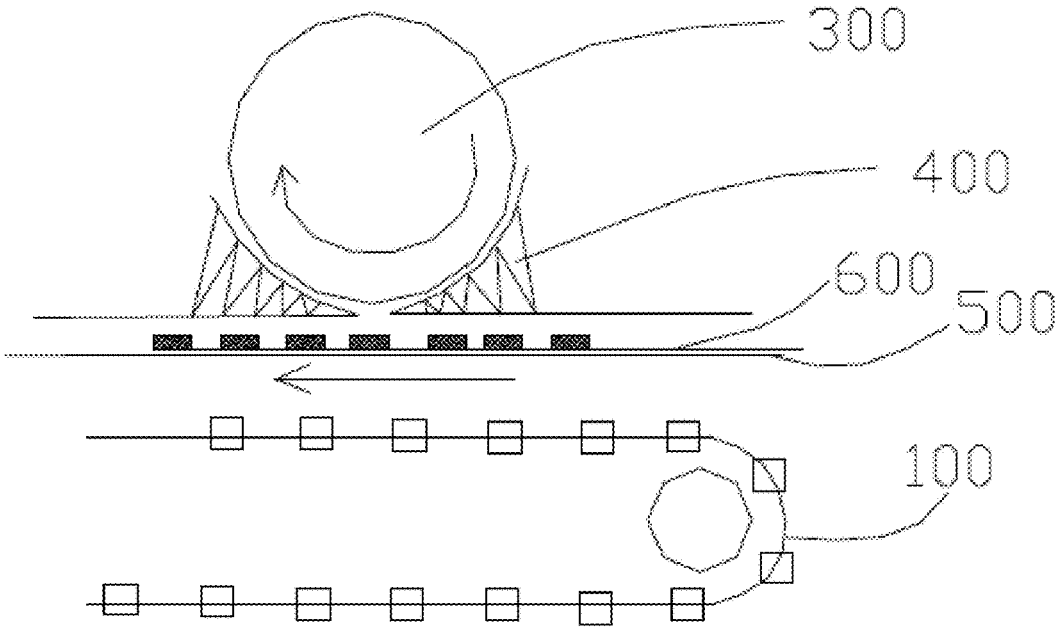
FIG. 3 is a cross-sectional schematic diagram illustrating the structure of a system for forming a security pattern by magnetic and optical fields according to Embodiment 3 of the present invention.

In the present embodiment, as shown in FIG. 3, a track-type magnetic field 100 synchronized with a conveying device is provided under the printing substrate 600 printed with the inducible ink pattern as described in Embodiment 1. The track-type magnetic field 100 can be a rubber-magnetic track or a magnetic plate loaded track. This embodiment employs a magnetic plate loaded track.

The printing substrate 600 is synchronized with the track-type magnetic field 100, which corresponds to the external magnetic field and the printing pattern being relatively rested for a period of time. In this way, as the printing substrate 600 moves, the light ray of the patterning roller 300 passes through the linear slit, and an optical field pattern is continuously formed on the surface of the printing substrate 600, and at the same time, since the track-type magnetic field 100 and the printing substrate 600 moves in synchronization with each other, the magnetic field forms a magnetic plate pattern on the surface of the printing substrate 600.

The advantage of this embodiment is that when the printing pattern passes through the affected area of the light roller, the external magnetic field, that is, the track-type magnetic field 100, still acts on the printing pattern, and has a more stable magnetic field than the magnetic roller, which provides more favorable conditions for preparing a more complicated and precise pattern.

In the above three embodiments, the printing substrate can be selected from a PVC black film, and a UV curable ink containing an inducible pigment flake is printed on a substrate of the PVC black film; the substrate printed with UV curable chromatic color-changing ink enters the magnetic field range and forms a magnetic plate pattern under the action of the magnetic field.

In the above three embodiments, the structure of the light roller is: the light roller consists of a film and two hollow glass cylinders, the film forms a cylindrical shape in a head-tail gluing after being bent, and forms a three-circle concentric cylinder with the two hollow glass cylinders, and an inner wall of one hollow glass cylinder and an outer wall of the other hollow glass cylinder tightly clamp the film to form a light roller of high resolution ratio.

Embodiment 4

The embodiment provides a security pattern formed by magnetic and optical fields, a system and a method for forming the security pattern.

With respect to Embodiments 1 to 3, the system for forming the security pattern of the present embodiment has the characteristics that two sets of security pattern forming units are used, that is, the printing substrate the having an inducible ink pattern printed on its surface sequentially passes through two sets of magnetic and optical field units so that the printing substrate sequentially passes through two sets of magnetic and optical field units.

The printing substrate of this embodiment is selected from a PVC black film, and a UV curable ink containing an inducible pigment flake is printed on a substrate of the PVC black film.

The first set of the magnetic and optical field unit consists of a pattern light roller provided above the conveyed printing substrate and a track-type cylindrical magnetic field provided below the printing substrate and conveyed synchronously with the printing substrate. The light shielding body is provided between the pattern light roller and the printing substrate and is configured to shield the pattern light roller to expose only a linear slit to the printing substrate. The second set of magnetic and optical field units consists of a UV light source provided above the printing substrate that continues to convey and a track-type spherical crown magnetic field provided below the printing substrate and conveyed synchronously with the printing substrate.

Figure 4:
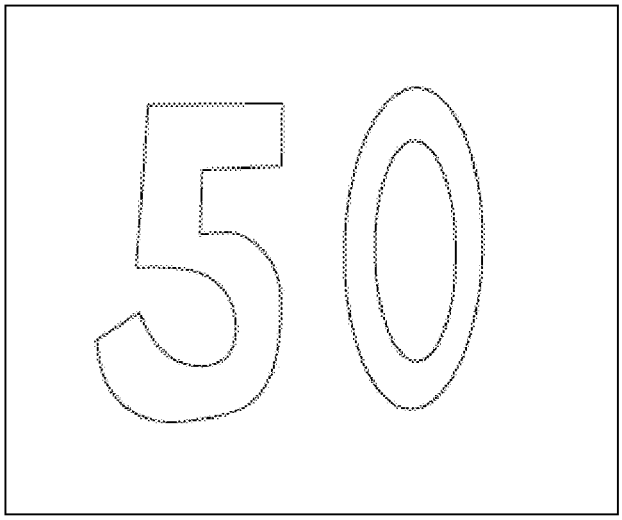
FIG. 4 to FIG. 6 are schematic diagrams illustrating a process of forming a security pattern according to Embodiment 4 of the present invention.
Figure 5:
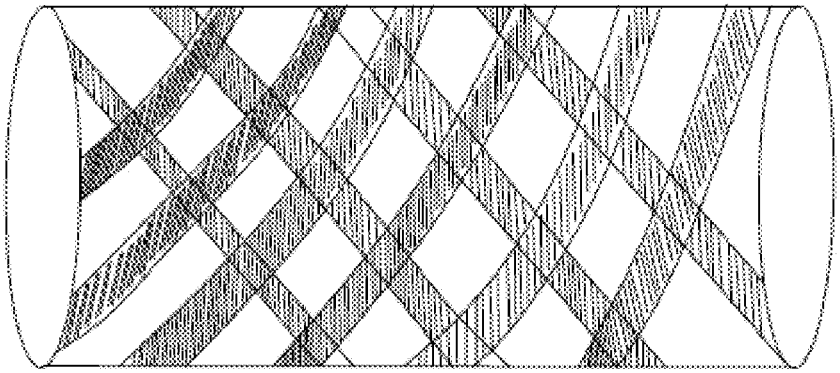
Figure 6:
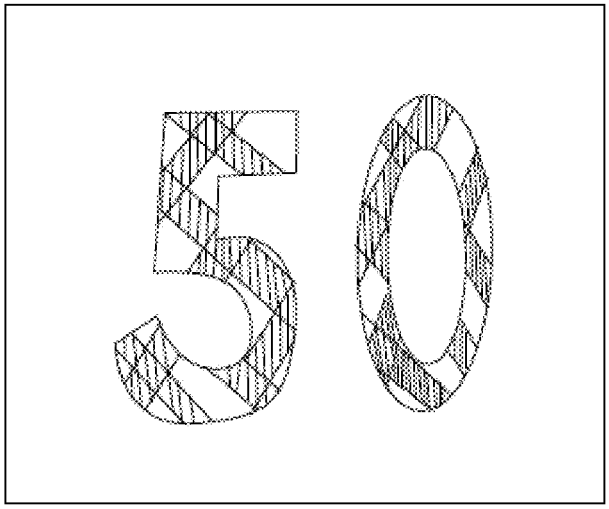

The process and principle of forming the safety pattern are shown in FIG. 4-6.

The printing substrate printed with "50" as shown in FIG. 4 passes through the first set of magnetic and optical field units, and the structure and pattern of the pattern light roller are as shown in FIG. 5. Through the influence of the track-type column magnetic field and the pattern light roller curing, the pattern "50" is cut into two parts: as shown in FIG. 5, the shaded part of the pattern "50" forms a rolling stripe corresponding to the pattern on the surface of the light roller, the pattern of the shaded part is cured, and the part except of the shaded part is not cured; at the same time, a first magnetic field pattern (not shown) generated due to the influence of the track-type columnar magnetic field is formed on the surface of the printing substrate. The printing substrate then passes through the second set of magnetic and optical field units, the pattern "50" on the surface of the printing substrate is cured by the UV light source so that the part except of the shadow is cured, so that the finally formed pattern is that the shaded part is a rolling color-changing pattern feature corresponding to the pattern on the surface of the light roller, and at the same time, a second magnetic field pattern (not shown) generated due to the influence of the track-type spherical coronal magnetic field is formed on the surface of the printing substrate.

In general, the pattern on the surface of the printing substrate after passing through the system for forming a security pattern of the present embodiment is formed by the common influence of the original printing pattern "50", the first magnetic field pattern, the second magnetic field pattern, and the pattern on the surface of the pattern light roller.

In practical applications, the number of security pattern forming units can be increased, thereby increasing the complexities of the security pattern formed. Moreover, each of the security pattern forming units may also use different light sources and magnetic fields to form a desired pattern effect.

Embodiment 5

The present embodiment provides a system for forming a variable safety pattern by magnetic and optical fields, comprising: a printing substrate having an inducible ink coating printed on its surface, and a magnetic and optical field system configured to form a variable security pattern on the surface of the printing substrate. The structure of the system is shown in FIG. 1. The difference between the present embodiment and Embodiment 1 is that the optical field is formed by a controllable light roller.

Figure 7:
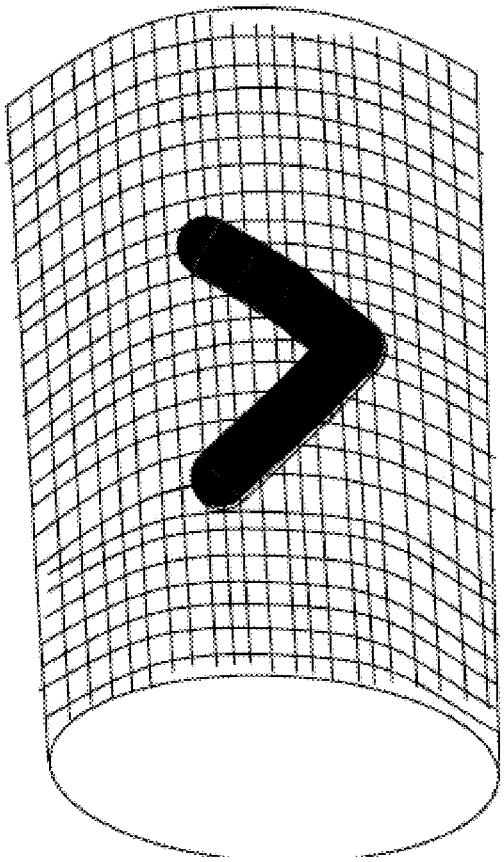
FIG. 7 is a perspective diagram illustrating the structure of a controllable optical roller according to Embodiment 5 of the present invention.

As shown in FIG. 7, the controllable light roller is mounted with several independently controllable light source units of the ink coating printed on the printing substrate and have curing function in an array on the roller surface of a certain size, preferably such that the light source units are distributed on the surface of the entire roller. By controlling the switch of the light source unit on the surface of the light roller, the light source units at certain specific positions are illuminated at different time points to form different optical patterns, which are then transferred to the coating on the surface of the printing substrate; the magnetic field is configured to form a magnetic field pattern on the surface of the coating of the printing substrate, which may be a permanent magnetic field, an electromagnetic field, or a track-type magnetic field. The shape of the permanent magnetic field or electromagnetic field may be a cylindrical, horseshoe, uniform magnetic or spherical crown magnetic field. The track-type magnetic field is a rubber magnetic track or a magnetic plate loaded track.

Specifically, in the embodiment, as shown in FIG. 1, the magnetic field of the magnetic and optical fields is a uniformly strong magnetic field formed by two magnetic poles 1 and 2 provided in parallel from top to bottom, a controllable light roller 3 provided between the two magnetic poles 1 and 2 of the magnetic field, a light shielding body 4, a conveying device 5, and a printing substrate 6 having an inducible ink pattern printed on its surface and conveyed by the conveying device 5. The controllable light roller 3 is provided above the printing substrate 6, the light shielding body 4 is provided between the pattern light roller 3 and the printing substrate 6 and is configured to shield the controllable light roller to expose only a linear slit to the printing substrate 6, the conveying device 5 is configured to drive the printing substrate 6 to move relative to the light shielding body 4; transfer the illuminated pattern on the surface of the controllable light roller 3 to the surface of the printing substrate 6 under the action of the rolling of the pattern light roller 3 and the magnetic field, and form a magnetic plate pattern on the surface of the printing substrate 6 from the magnetic field formed by the shape of the magnetic field or the pattern on the surface of the magnetic pole at the same time. The linear slit may be a straight line or a line-type pattern.

The linear slit of this embodiment has a width of 0.1-3 mm, preferably 0.5-1 mm, and the light-emitting unit on the controllable light roller 3 is a rectangle having a physical size of 0.1-3 square millimeters.

In the present embodiment, the conveying device 5 is a conveyor belt.

Another implementation manner of this embodiment is as shown in FIG. 2, and adopts a 'round to round' manner. The structure is similar to that shown in FIG. 1. The difference is only that the conveying device below the pattern light roller 30 of the two magnetic poles 10, 20 provided in parallel from top to bottom is a cylindrical conveying roller 50, and the cylindrical conveying roller 50 is rolled by autorotation so that the printing substrate 60 on the surface thereof is rolled and conveyed, thereby transferring the pattern on the surface of the patterning roller 30 to the surface of the printing substrate 60.

As shown in FIG. 7, at a certain moment, in the light source unit of the surface of the controllable light roller, the illuminated part is in the shape of 'V', and the illuminated light source units cure the surface on the printing substrate 6 or 60 passing under the controllable light roller so that the cured ink part is also in the shape of 'V'. At the next moment, the illuminated part of the light source unit on the surface of the controllable light roller may have other patterns and transfer the pattern to the surface of the passed printing substrate 6 or 60. Thus, the patterns on the controllable light roller are different at each moment, so that the ink on the surface of the passed printing substrate 6 or 60 has different cured patterns, thereby realizing variable security patterns, instead of being unchanged. The pattern formed by the illuminated light source unit of the controllable light roller can be manually controlled or intelligently controlled.

Embodiment 6

This embodiment provides a system for forming a variable security pattern by magnetic and optical fields, which is similar to Embodiment 5 except that the optical field used is different.

Figure 8:
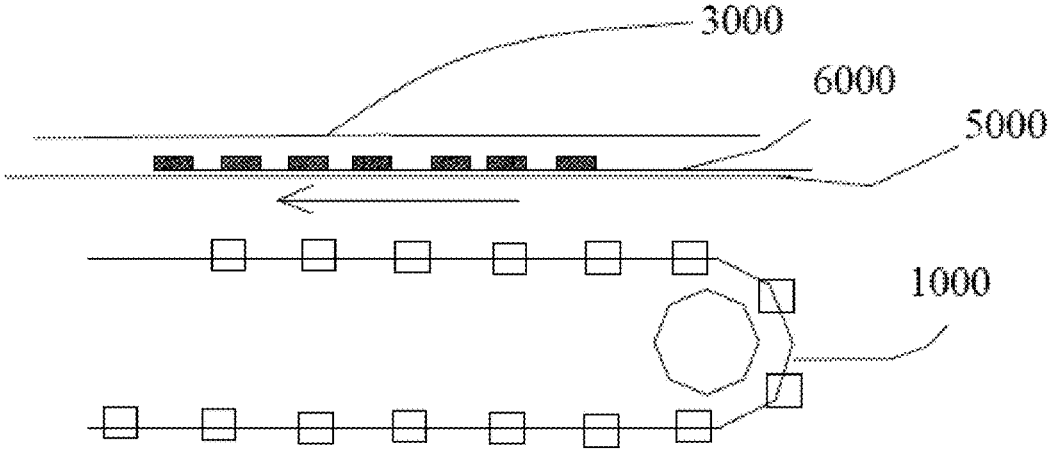
FIG. 8 is a cross-sectional schematic diagram illustrating the structure of a system for forming a variable security pattern by magnetic and optical fields according to Embodiment 6 of the present invention.

As shown in FIG. 8, the magnetic and optical fields of the present embodiment comprise a linear writing light source 3000 and a track-type magnetic field 1000 provided opposite to each other from top to bottom, and a conveying device 5000 configured to convey the printing substrate 6000, the printing substrate 6000 is provided between the linear writing light source 3000 and the magnetic field 1000, the track-type magnetic field 1000 is synchronized with the conveying device 5000, the pattern pre-written by the linear writing light source 3000 is transferred to the surface of the printing substrate 6000 by control of the linear writing light source 3000 and movement of the track-type magnetic field 1000, and a magnetic plate pattern is formed on the surface of the printing substrate 6000 from the track-type magnetic field 1000 at the same time. The track-type magnetic field 1000 is a rubber magnetic track or a magnetic plate loaded track.

The linear writing light source 3000 is a single row of light sources consisted of several single-point writing light sources, which is capable of curing the ink coating printed on the surface of the printing substrate 6000, and achieves a change in the optical signal of the overall linear writing light source 3000 by controlling the on/off of the single-point writing light sources so that the ink coating continuously passing through the surface of the printing substrate 6000 below the linear writing light source 3000 exhibits a special pattern. Each row of light sources has a line width of 0.1 to 3 mm, preferably 0.5 to 1 mm, and the light-emitting system thereof is combined by applying an applied optical system, a fiber system, and a light baffle or the like. The light-emitting part of the linear writing light source is a rectangle of no more than 0.1 to 1 square millimeters.

The printing substrate 6000 is synchronized with the track-type magnetic field 1000, which corresponds to the external magnetic field and the printing pattern being relatively rested for a period of time. In this way, as the printing substrate 6000 moves, the light ray of the patterning roller 3000 passes through the linear slit, and an optical field pattern is continuously formed on the surface of the printing substrate 6000, and at the same time, since the track-type magnetic field 1000 and the printing substrate 6000 moves in synchronization with each other, the track-type magnetic field 1000 induces pigment flakes in the ink pattern on the surface of the printing substrate 6000 to form a magnetic plate pattern.

Another implementation method of this embodiment is as follows: the magnetic field is stationary, the pattern pre-written by the linear writing light source is transferred to the surface of the printing substrate by control of the linear writing light source, and the magnetic field formed by the shape of the magnetic field or the pattern on the surface of the magnetic pole transfers the magnetic pattern to the ink pattern by inducing the pigment flakes in the ink pattern on the surface of the printing substrate at the same time, that is, a magnetic plate pattern is formed on the surface of the printing substrate.

An example of the linear writing light source of the present embodiment is listed below. Under the premise that the linear slit is linear, in the process that the printing substrate passes under the linear slit, a single-point writing light source at one or some specific positions of the linear writing light source is controlled to be illuminated and other single-point writing light sources are turned off at each moment. The pattern of the illuminated part of the linear writing light source is "5" within a period of time, which is the pre-writing pattern in this embodiment. It can be traced back at which position the single-point writing light source is controlled to be illuminated every second, for example, at the 10th second. The pigment flakes in the ink pattern on the surface of the printing substrate are induced by the linear writing light source to obtain the pattern "5", i.e., the linear writing light source transfers the pattern into the ink pattern on the surface of the printing substrate. In the next time period, the linear writing light source is free to present a new pre-writing pattern.

Embodiment 7

This embodiment employs two sets of magnetic and optical field systems designed to prepare a more complicated variable magnetic and optical field pattern.

Specifically, the first magnetic and optical field comprises an optical field and a first magnetic field provided with respect to each other. As shown in the first embodiment, the optical field consists of a controllable light roller and a light shielding body, and the first magnetic field may be a permanent magnetic field, an electromagnetic field, or a track-type magnetic field. The second magnetic and optical field consists of a UV curing light source and a second magnetic field provided with respect to each other.

The illuminated light source unit of the controllable light roller forms into a grid pattern of two-dimensional code, when the printing substrate having inducible ink coating printed on its surface passes, the part of the ink coating corresponding to the grid pattern of the two-dimensional code is cured by the controllable light roller, in the process, all the inducible materials in the ink coating on the surface of the printing substrate have a change in arrangement under the action of the first magnetic field, the grid part of the two-dimensional code is cured after being changed, and the part except of the grid part of the two-dimensional code is not cured. The printing substrate then passes through the second magnetic and optical field, the ink coating except of the grid part of the two-dimensional code is influenced by the second magnetic field, and the arrangement angle of the inducible materials in the ink coating is changed again and is cured by the UV curing light source, so that the part except of the grid part of the two-dimensional code is also cured while being changed.

The magnetic fields used in this embodiment are different, and the microscopic details of the finally formed two-dimensional code are different: different magnetic fields can induce inducible materials of the grid part of the two-dimensional code differently, so that the inducible material of the two-dimensional code part and the part other than the two-dimensional code have different arrangement angles, different distributions of the arrangement angles, and the like.

In practical applications, more than two sets of magnetic and optical fields can be provided, so that the printing substrate sequentially passes through the plurality of sets of systems, thereby forming a more complicated variable security pattern on the surface of the printing substrate. Moreover, in each system, different sources and magnetic fields can be used to form a desired pattern effect.

What is claimed is:

1. A system for forming a security pattern by magnetic and optical fields, comprising: a printing substrate having an inducible ink pattern printed on its surface, and at least one set of security pattern forming units through which the printing substrate passes sequentially, wherein each set of security pattern forming units comprises: a magnetic field and a light source each acting on a surface of the printing substrate, such that after the printing substrate passes through the security pattern forming unit, an inducible ink pattern on the surface thereof exhibits the effect of the dual function of the optical field and the magnetic field, wherein each set of security pattern forming units comprises: an external magnetic field, a conveying device provided between two magnetic poles of the external magnetic field or at a single pole of the magnetic field, a pattern light roller having a pattern light source on the surface, and a light shielding body; wherein the pattern light roller is provided above the printing substrate, the light shielding body is provided between the pattern light roller and the printing substrate and is configured to shield the pattern light roller to expose only a linear slit to the printing substrate, the conveying device is configured to drive the printing substrate to move relative to the light shielding body; transfer the pattern on the surface of the pattern light roller to the surface of the printing substrate under the action of the external magnetic field by rolling the pattern light roller, and form a magnetic plate pattern on the surface of the printing substrate from the magnetic field formed by the shape of the external magnetic field or the pattern on the surface of the magnetic pole at the same time.

2. The system for forming a security pattern by magnetic and optical fields according to claim 1, wherein the external magnetic field is a permanent magnetic field, an electromagnetic field, and a track-type magnetic field synchronized with the conveying device; and the shape of the permanent magnetic field or electromagnetic field is a cylindrical, horseshoe, uniform magnetic or spherical crown magnetic field.

3. The system for forming a security pattern by magnetic and optical fields according to claim 2, wherein the track-type magnetic field is a rubber magnetic track or a magnetic plate loaded track, and a magnetic device is 0.01-10 cm away from the surface of the printing substrate.

4. The system for forming a security pattern by magnetic and optical fields according to claim 1, wherein: the printing substrate is selected from paper or plastic, and a UV curable ink containing an inducible pigment flake is printed on a substrate.

5. The system for forming a security pattern by magnetic and optical fields according to claim 1, wherein both the conveying device and the printing substrate below the pattern light roller are planar, and the pattern on the pattern light roller is transferred to the surface of the printing substrate by one-way translation of the conveying device.

6. The system for forming a security pattern by magnetic and optical fields according to claim 1, wherein the conveying device located below the pattern light roller is a cylindrical conveying roller, and the printing substrate on a surface thereof is rolled and conveyed therefrom, thereby transferring the pattern on the pattern light roller to the surface of the printing substrate.

7. The system for forming a security pattern by magnetic and optical fields according to claim 1, wherein the pattern light roller is a structure provided with a light source in the internal part and a hollow pattern in the external part.

8. The system for forming a security pattern by magnetic and optical fields according to claim 7, wherein the pattern light roller consists of a film and two hollow glass cylinders, the film forms a cylindrical shape in a head-tail gluing after being bent, and forms a three-circle concentric cylinder with the two hollow glass cylinders, and an inner wall of one hollow glass cylinder and an outer wall of the other hollow glass cylinder tightly clamp the film to form a light roller of high resolution ratio.

9. A system for forming a security pattern by magnetic and optical fields, comprising: a printing substrate having an inducible ink coating printed or coated on its surface, and at least one set of magnetic and optical field units configured to form a variable security pattern on the surface of the printing substrate, wherein the printing substrate sequentially passes through the at least one set of magnetic and optical field units; each of the magnetic and optical field units comprises a magnetic field provided with respect to each other and an optical field having curing function for the ink coating printed on the substrate, the printing substrate passes between the optical field and the magnetic field, in the process, the magnetic field induces the pigment flakes of the ink coating on the surface of the printing substrate in the area corresponding to the magnetic field to change their arrangement direction, and the part of the ink coating corresponding to the optical field is cured by the optical field; the optical field in at least one set of magnetic and optical field units is formed by a variable controllable light roller, a linear writing light source or laser, at different time points, the light-emitting points of the controllable light roller, the linear writing light source or the laser are controlled to form a unique optical field pattern, so that the part of the ink coating on the surface of the printing substrate corresponding to the optical field pattern is cured to form a unique security pattern;

wherein the magnetic and optical fields further comprises: a conveying device provided between two magnetic poles of the magnetic field or at a single pole of the magnetic field, and a light shielding body; wherein the controllable light roller is provided above the printing substrate, the light shielding body is provided between the controllable light roller and the printing substrate and is configured to shield the controllable light roller to expose only a linear slit to the printing substrate, the conveying device is configured to drive the printing substrate to move relative to the light shielding body; transfer the pattern on the surface of the controllable light roller to the surface of the printing substrate under the action of the magnetic field by rolling the controllable light roller, and form a magnetic plate pattern on the surface of the printing substrate from the magnetic field formed by the shape of the magnetic field or the pattern on the surface of the magnetic pole at the same time.

10. The system according to claim 9, wherein the magnetic field is a permanent magnetic field, an electromagnetic field, and a track-type magnetic field synchronized with the conveying device; the shape of the permanent magnetic field or electromagnetic field is a cylindrical, horseshoe, uniform magnetic or spherical crown magnetic field, the track-type magnetic field is a rubber magnetic track or a magnetic plate loaded track, and a magnetic device is 0.01-10 cm away from the surface of the printing substrate.

11. The system according to claim 9, wherein the controllable light roller is mounted with several independently controllable light source units in an array on the roller surface of a certain size, the light source units have curing function for the ink coating on the printing substrate; and different optical patterns are formed at different time points by controlling the switch of the light source unit on the surface of the light roller.

12. The system according to claim 9, wherein the linear slit has a line width of 0.1 to 3 mm, and the light-emitting unit on the controllable light roller is a rectangle having a physical size of no more than 0.1 to 3 square millimeters.

13. The system according to claim 9, wherein both the conveying device and printing substrate below the controllable light roller are planar, and the pattern on the controllable light roller is transferred to the surface of the printing substrate by one-way translation of the conveying device; alternatively, the conveying device is a cylindrical conveying roller, and the light shielding body matches the shape of the conveying roller.

14. The system according to claim 13, wherein the linear writing light source is a single row of light sources consisted of several single-point writing light sources, which achieves a change in the optical signal of the overall linear writing light source by controlling the on/off of the single-point writing light sources and has curing function for the ink coating printed on the substrate, each row of light sources has a line width of 0.1 to 3 mm, and the light-emitting system thereof is combined by an applied optical system, a fiber system, and a light baffle or the like.

15. A system according to claim 14, wherein the light-emitting part of the linear writing light source is a rectangle of no more than 0.1 to 1 square millimeters.

16. The system according to claim 9, wherein the optical field is consisted of a linear writing light source, the magnetic field is a track-type magnetic field or a stationary magnetic field; the magnetic and optical fields further comprise a conveying device configured to convey the printing substrate, the printing substrate is provided between the linear writing light source and the magnetic field, when the magnetic field is a track-type magnetic field, the track-type magnetic field is synchronized with the conveying device, the pattern pre-written by the linear writing light source is transferred to the surface of the printing substrate by control of the linear writing light source and movement of the track-type magnetic field, and a magnetic plate pattern is formed on the surface of the printing substrate from the track-type magnetic field at the same time; when the magnetic field is a stationary magnetic field, the pattern pre-written by the linear writing light source is transferred to the surface of the printing substrate by control of the linear writing light source, and a magnetic plate pattern is formed on the surface of the printing substrate from the magnetic field formed by the shape of the magnetic field or the pattern on the surface of the magnetic pole at the same time.

17. The system according to claim 9, comprising two sets of magnetic and optical field units, wherein the first magnetic and optical field unit comprises an optical field and a first magnetic field provided with respect to each other, the optical field consists of a controllable light roller and a light shielding body, the second magnetic and optical field unit consists of a UV curing light source and a second magnetic field provided with respect to each other; the illuminated light source unit of the controllable light roller forms into a grid pattern of two-dimensional code, when the printing substrate having inducible ink coating printed on its surface passes, the part of the ink coating corresponding to the grid pattern of the two-dimensional code is cured by the controllable light roller, in the process, all the inducible materials in the ink coating on the surface of the printing substrate have a change in arrangement under the action of the first magnetic field, the grid part of the two-dimensional code is cured after being changed, the printing substrate then passes through the second magnetic and optical field unit, the ink coating except of the grid part of the two-dimensional code is influenced by the second magnetic field, and the arrangement angle of the inducible materials in the ink coating is changed again and is cured by the UV curing light source, so that the part except of the grid part of the two-dimensional code is also cured while being changed.

* * * * *